US008567357B2

(12) United States Patent
Honzen et al.

(10) Patent No.: US 8,567,357 B2
(45) Date of Patent: Oct. 29, 2013

(54) COOLANT CIRCUIT FOR AN INTERNAL COMBUSTION ENGINE

(75) Inventors: Matthias Honzen, Ludwigsburg (DE); Christoph Anton, Leingarten (DE); Sebastian Riedl, Neckarsulm (DE)

(73) Assignee: Audi AG, Ingolstadt (DE)

( * ) Notice: Subject to any disclaimer, the term of this patent is extended or adjusted under 35 U.S.C. 154(b) by 68 days.

(21) Appl. No.: 13/092,626

(22) Filed: Apr. 22, 2011

(65) Prior Publication Data

US 2011/0265741 A1 Nov. 3, 2011

(30) Foreign Application Priority Data

Apr. 28, 2010 (DE) ..... 10 2010 018 624

(51) Int. Cl.
*F01P 3/00* (2006.01)
*F01P 7/14* (2006.01)

(52) U.S. Cl.
USPC ..... 123/41.29; 123/41.08

(58) Field of Classification Search
USPC ..... 123/41.08, 41.29
See application file for complete search history.

(56) References Cited

U.S. PATENT DOCUMENTS

| | | | | |
|---|---|---|---|---|
| 5,048,467 | A * | 9/1991 | Kojima | 123/41.74 |
| 5,497,734 | A * | 3/1996 | Okada | 123/41.1 |
| 6,595,164 | B2 * | 7/2003 | Kunze et al. | 123/41.1 |
| 6,745,728 | B2 | 6/2004 | Batzill | |
| 7,721,683 | B2 | 5/2010 | Lutz et al. | |
| 2007/0062466 | A1 * | 3/2007 | Engelin et al. | 123/41.1 |
| 2009/0007775 | A1 * | 1/2009 | Seymour et al. | 92/149 |

FOREIGN PATENT DOCUMENTS

| | | | |
|---|---|---|---|
| DE | 198 03 885 | A1 | 8/1999 |
| DE | 100 21 525 | A1 | 11/2001 |
| DE | 103 18 744 | A1 | 11/2004 |
| DE | 102006044680 | | 4/2008 |
| EP | 1 947 308 | A1 | 7/2008 |
| JP | 60-19912 | | 2/1985 |

* cited by examiner

*Primary Examiner* — Lindsay Low
*Assistant Examiner* — Tea Holbrook
(74) *Attorney, Agent, or Firm* — Henry M. Feiereisen LLC

(57) ABSTRACT

A coolant circuit for an internal combustion engine having a cylinder crankcase with at least two opposing cylinder banks, and cylinder heads associated to the cylinder banks, includes a first subcircuit for cooling the cylinder crankcase and a second subcircuit in separate parallel relationship to the first subcircuit for cooling the cylinder heads. A coolant pump circulates a coolant at least temporarily between a main heat exchanger and the cylinder heads and/or cylinder crankcase. At least one check valve is arranged in the first subcircuit to allow a flow of coolant through the cylinder banks only in a direction from an intake side to an exhaust side.

10 Claims, 1 Drawing Sheet

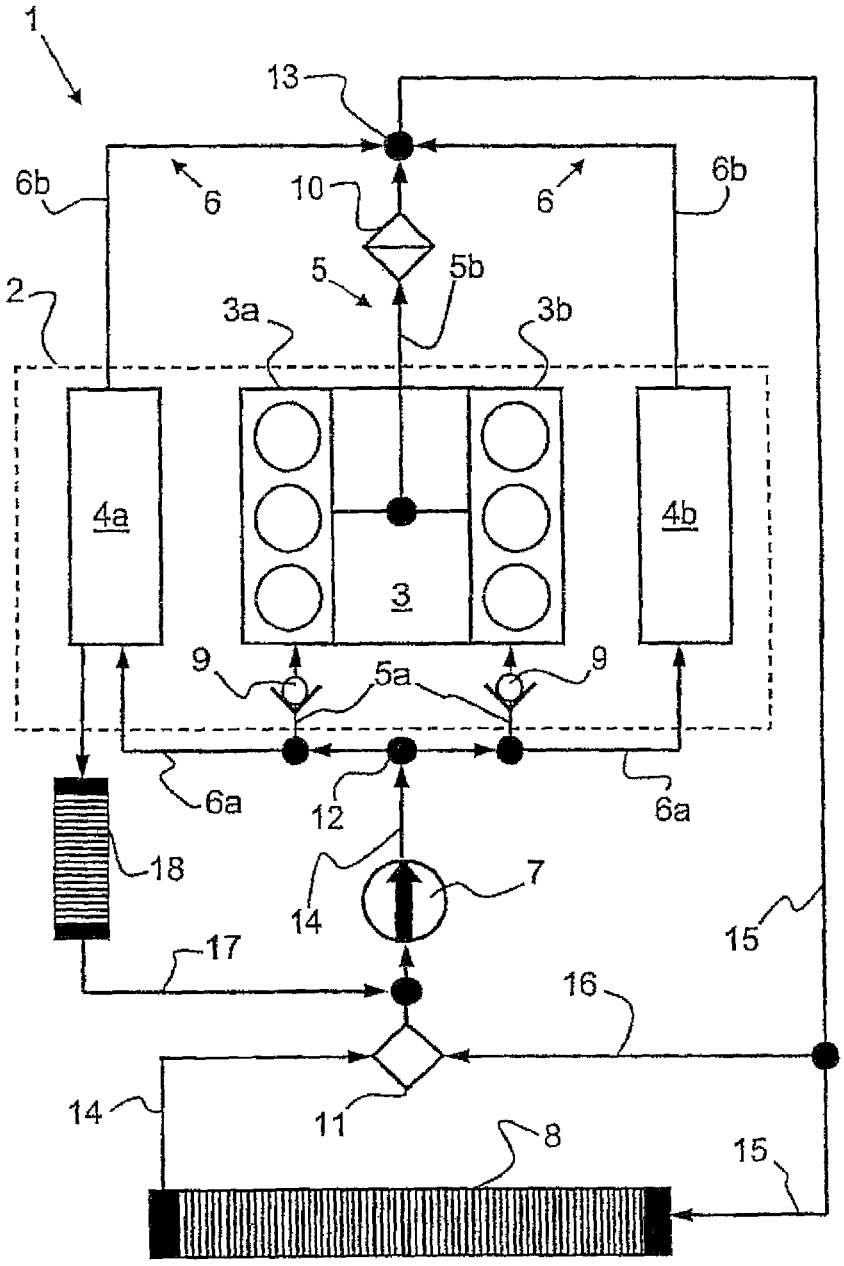
1
13
6b
6
10
6
6b
5
5b
2
3a
3b
4a
4b
3
9
5a
9
6a
12
6a
18
7
14
15
17
16
14
11
8
15

COOLANT CIRCUIT FOR AN INTERNAL COMBUSTION ENGINE

CROSS-REFERENCES TO RELATED APPLICATIONS

This application claims the priority of German Patent Application, Serial No. 10 2010 018 624.4, filed Apr. 28, 2010, pursuant to 35 U.S.C. 119(a)-(d), the content of which is incorporated herein by reference in its entirety as if fully set forth herein.

BACKGROUND OF THE INVENTION

The present invention relates to a coolant circuit for an internal combustion engine.

The following discussion of related art is provided to assist the reader in understanding the advantages of the invention, and is not to be construed as an admission that this related art is prior art to this invention.

Coolant circuits are typically used in internal combustion engines for motor vehicles for cooling components of the internal combustion engine, for example cylinder heads and cylinder crankcases, to a different temperature level. An example of a coolant circuit involves a construction in two-circuit cooling configuration for an internal combustion engine having at least two cylinder banks in parallel relationship in V or W configuration. A V-configuration for example involves cylinder banks in opposite relation.

U.S. Pat. No. 6,745,728 discloses a coolant circuit for a multi-cylinder internal-combustion engine constructed as a V-engine. A cooling jacket surrounds a cylinder head housing and a cylinder block and is supplied with cooling liquid by way of a pump. The cylinder cooling jacket and the cylinder head cooling space are provided with a connection for feeding the cooling liquid and with the cooling liquid flowing parallel through the cylinder head housing and the cylinder block. To more rapidly heat the cooling liquid in cooling jacket, the connection of the cylinder cooling jacket is blocked, while coolant flows through the cylinder head cooling space. This causes an undesired coolant movement in the cylinder cooling jacket as a result of cross-flows, thereby slowing down a heating of the cylinder block.

It would therefore be desirable and advantageous to address the problem of cross coolant flows and to obviate other prior art shortcomings.

SUMMARY OF THE INVENTION

According to one aspect of the present invention, a coolant circuit for an internal combustion engine having a cylinder crankcase with at least two opposing cylinder banks, and cylinder heads associated to the cylinder banks, includes a first subcircuit for cooling the cylinder crankcase, a second subcircuit in separate parallel relationship to the first subcircuit for cooling the cylinder heads, a main heat exchanger, a coolant pump for circulating a coolant at least temporarily between the main heat exchanger and the cylinder heads and/or cylinder crankcase, and at least one check valve arranged in the first subcircuit to allow a flow of coolant through the cylinder banks only in a direction from an intake side to an exhaust side.

By providing at least one check valve in the cylinder crankcase subcircuit to allow a flow of coolant through the cylinder banks only in a direction from an intake side to an exhaust side and thus to block a coolant flow through the cylinder banks from the exhaust side to the intake side, an undesired cross-flow of coolant in the cylinder crankcase between the cylinder banks can be prevented, regardless of the coolant flow in the cylinder head subcircuit. The cylinder crankcase has normally a single coolant jacket in surrounding relationship to both cylinder banks so that an induced coolant movement renders a coolant exchange between the cylinder banks in theory principally possible at any time. The presence of a check valve in the subcircuit for the cylinder crankcase prevents however the cross-flow of coolant, caused by a coolant flow in the parallel cylinder head subcircuit, between the cylinder banks. This functional principle is applicable for internal combustion engines constructed as V-engine or W-engine or flat engines (boxer engine).

According to another advantageous feature of the present invention, each cylinder bank can be acted upon via a separate cylinder crankcase lead flow with coolant which can be drained via a common cylinder crankcase return flow. Advantageously, each of the cylinder crankcase lead flows has a check valve to allow a coolant flow only from the cylinder crankcase lead flows through the cylinder banks to the cylinder crankcase return flow. By providing each separate cylinder crankcase lead flow with its own check valve that permits a coolant flow only to the common return flow, coolant which may enter a cylinder crankcase lead flow as a result of a coolant movement in the cylinder head subcircuit can no longer exit the opposite cylinder crankcase lead flow and thus establish a cross-flow between the parallel cylinder banks. As a result, the cylinder crankcase can heat up much faster as a result of "standing" coolant and reaches its optimum friction work earlier. Advantageously, the cylinder crankcase return flow is drawn at a location of the cylinder crankcase that ensures coolant to evenly flow around the engine displacements in the cylinder banks.

According to another advantageous feature of the present invention, a first control valve can be provided for controlling a coolant flow in the cylinder crankcase return flow. The first control valve can be used to cut the cylinder crankcase subcircuit, suitably in the warm-up phase, to realize a rapid heating of the cylinder crankcase. Advantageously, the first control valve can be configured in the form of an infinitely variable control valve so that the coolant temperature can be continuously adjusted in the cylinder crankcase. In combination with the check valves in the cylinder crankcase lead flows, the first control valve, arranged in the cylinder crankcase return flow, can optionally produce "standing" coolant in the cylinder crankcase without encountering any cross-flows between the cylinder banks.

According to another advantageous feature of the present invention, each cylinder head may have its own cylinder head lead flow and its own cylinder head return flow, with the cylinder crankcase lead flows and the cylinder head lead flows splitting at a branch point which is in fluid communication with a common lead flow section downstream of the coolant pump, and with the cylinder crankcase return flow and the cylinder head return flows being united again in a common return flow section at a connection point downstream of the first control valve. The cylinder heads associated to the cylinder banks of the cylinder crankcase form separate structures and thus are supplied in the cylinder head subcircuit centrally and in parallel with coolant from the coolant pump via separate cylinder head lead flows and cylinder head return flows. The cylinder head lead flows branch hereby jointly with the cylinder crankcase lead flows at a branch point from a common lead flow section in which the coolant pump is disposed. In an analogous manner, the coolant flows from the cylinder head return flows and the central cylinder crankcase return flow, after flowing through the respective subcircuits and the incorporated components, are united again in a common return flow section at a connection point. The common return flow section leads to an inlet of the main heat exchanger, whereas the common lead flow section leads away on the opposite side of the main heat exchanger from the outlet thereof.

According to another advantageous feature of the present invention, a second control valve can be arranged in the common lead flow section between the main heat exchanger and the coolant pump, and a branch line may extend from the common return flow to the second control valve to bypass the main heat exchanger. The branch line optionally allows a bypass of the main heat exchanger, when appropriately switching the second control valve. In the bypass operation, a coolant flow can be established in the cylinder heads and in dependence on the first control valve also in the cylinder crankcase, without cooling down the heated coolant in the main heat exchanger. As a result, the internal combustion engine can be quickly and evenly heated to an elevated temperature level. As an alternative, the second control valve may be switched to close off the branch line, when a certain minimum temperature has been reached, so that the coolant can be routed across the main heat exchanger. The second control valve may be configured as an infinitely variable control valve. Currently preferred is however a configuration of the second control valve in the form of a map-controlled thermostat to which current may optionally be applied to change ignition mapping.

BRIEF DESCRIPTION OF THE DRAWING

Other features and advantages of the present invention will be more readily apparent upon reading the following description of currently preferred exemplified embodiments of the invention with reference to the accompanying drawing, in which the FIGURE is a schematic illustration of a coolant circuit according to the present invention.

DETAILED DESCRIPTION OF PREFERRED EMBODIMENTS

The depicted embodiment is to be understood as illustrative of the invention and not as limiting in any way. It should also be understood that the figure is not necessarily to scale and that embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the FIGURE, there is shown a schematic illustration of a coolant circuit according to the present invention, generally designated by reference numeral 1, for an internal combustion engine 2. The coolant circuit 1 includes a coolant pump 7 for producing a coolant circulation in the coolant circuit 1, and a main heat exchanger 8 for heat exchange between ambient air sweeping about the main heat exchanger 8 and coolant flowing through the main heat exchanger 8. The internal combustion engine 2 has essentially a cylinder crankcase 3, which includes the displacements of the working cylinders in two cylinder banks 3*a*, 3*b* disposed in parallel confronting relationship and which is surrounded by a single coolant jacket, and cylinder heads 4*a*, 4*b* which are associated to the cylinder banks 3*a*, 3*b* and substantially house the devices for gas exchange for the working cylinders and which are also surrounded by a coolant jacket. The coolant jackets of the cylinder heads 4*a*, 4*b* and the cylinder crankcase 3 are not in internal fluid communication but incorporated in separate subcircuits 5, 6 of the coolant circuit 1 in parallel relationship. Each of the cylinder heads 4*a*, 4*b* and each of the cylinder banks 3*a*, 3*b* of the cylinder crankcase 2 have a separate lead flow connection 6*a* and 5*a*, respectively, which is supplied with coolant via a common lead flow section 14 in which the coolant pump 7 is disposed.

The common lead flow section 14 branches off at a branch point 12 for dispersing the coolant to both sides of the V-shaped internal combustion engine 2 until it is split further between cylinder head 4*a* or 4*b* and cylinder bank 3*a* or 3*b*. The cylinder crankcase 3 has a single cylinder crankcase return flow 5*b* which originates from the coolant jacket of the cylinder crankcase 3, which coolant jacket is filled with coolant from the cylinder crankcase lead flows 5*a*. The cylinder heads 4*a*, 4*b* have their own cylinder head return flows 6*b* which come together with the cylinder crankcase return flow 5*b* at a connection point 13 and merge with the common return flow section 15. The common return flow section 15 leads to the input side of the main heat exchanger 8 whereas the common lead flow section 14 leads away from the outlet side of the main heat exchanger 8.

In addition to the central coolant pump 7, the common lead flow section 14 includes a second control valve 11 which is disposed upstream of the coolant pump 7 and operatively connected to a branch 16 which branches off the common return flow section 15 and bypasses the main heat exchanger 8. The second control valve 11 is constructed as a current-carrying map-controlled thermostat which in one switching state closes the branch 16 in dependence on coolant temperature threshold values that can be changed by applying current so that the coolant is routed across the main heat exchanger 8. In another switching state, the second control valve 11 circumvents the main heat exchanger 8 and routes the coolant via the branch 16 to the coolant pump 7.

A first control valve 10, constructed as an infinitely variable ball valve, is disposed in the cylinder crankcase return flow 5*b* to optionally block the cylinder crankcase return flow 5*b*. Check valves 9 are disposed in the cylinder crankcase lead flows 5*a* on the input side of the cylinder banks 3*a*, 3*b* to permit a coolant flow only from the cylinder crankcase lead flows 5*a* in the direction of the cylinder crankcase return flow 5*b*. As a result, when the cylinder crankcase return flow 5*b* is blocked, a coolant amount migrating through one of the cylinder crankcase lead flows 5*a* into one of the two cylinder banks 3*a* or 3*b* cannot force back again a corresponding amount of coolant on the opposite cylinder bank 3*a* or 3*b* into the respective cylinder crankcase lead flow 5*a*. An undesired cross-flow between the cylinder banks 3*a*, 3*b* is therefore prevented. A heating circuit 17 with incorporated heat exchanger 18 for heating ambient air for a vehicle interior may lead away from one of the cylinder heads 4*a* or 4*b* and feeds again into the common lead flow section 14 upstream of the coolant pump 7 and downstream of the second control valve 11.

While the invention has been illustrated and described in connection with currently preferred embodiments shown and described in detail, it is not intended to be limited to the details shown since various modifications and structural changes may be made without departing in any way from the spirit and scope of the present invention. For example, further heat exchangers may be added in further subcircuits, or a venting system with compensation reservoir may be connected to the coolant circuit. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

What is claimed is:

1. A coolant circuit for an internal combustion engine having a cylinder crankcase with at least two opposing cylinder banks, and cylinder heads associated to the cylinder banks, said coolant circuit comprising:

a first subcircuit for cooling the cylinder crankcase;

a second subcircuit in separate parallel relationship to the first subcircuit for cooling the cylinder heads;

a main heat exchanger;

a coolant pump for circulating a coolant at least temporarily between the main heat exchanger and the cylinder heads and/or cylinder crankcase; and at least one check valve arranged in the first subcircuit to allow a flow of coolant through the cylinder banks only in a direction from an intake side to an exhaust side.

2. The coolant circuit of claim 1, further comprising two separate cylinder crankcase lead flows connected to the cylinder banks in one-to-one correspondence for feeding coolant to the cylinder banks, and a common cylinder crankcase return flow in fluid communication with the cylinder crankcase lead flows for draining coolant.

3. The coolant circuit of claim 2, wherein the check valve is arranged in one of the cylinder crankcase lead flows, and further comprising a second said check valve arranged in the other one of the cylinder crankcase lead flows, said check valves being constructed to permit a flow of coolant only in a direction from the cylinder crankcase lead flows through the cylinder banks into the cylinder crankcase return flow.

4. The coolant circuit of claim 2, further comprising a first control valve for controlling a coolant flow in the cylinder crankcase return flow.

5. The coolant circuit of claim 4, wherein the first control valve is constructed as an infinitely variable control valve.

6. The coolant circuit of claim 2, further comprising two cylinder head lead flows connected to the cylinder heads in one-to-one correspondence for feeding coolant to the cylinder heads, and two cylinder head return flows in fluid communication with the cylinder head lead flows in one-to-one correspondence for draining coolant, wherein the cylinder crankcase lead flows and the cylinder head lead flows split at a branch point which is in fluid communication with a common lead flow section downstream of the coolant pump, and wherein the cylinder crankcase return flow and the cylinder head return flows are united at a connection point downstream of the first control valve in a common return flow section.

7. The coolant circuit of claim 6, wherein the common return flow section is configured to lead to the main heat exchanger.

8. The coolant circuit of claim 6, wherein the common lead flow section leads away from the main heat exchanger.

9. The coolant circuit of claim 6, further comprising a second control valve arranged in the common lead flow section between the main heat exchanger and the coolant pump, and a branch line extending from the common return flow section to the second control valve and bypassing the main heat exchanger.

10. The coolant circuit of claim 9, wherein the second control valve is configured in the form of a map-controlled thermostat.

* * * * *